US007793641B2

(12) United States Patent
Ma et al.

(10) Patent No.: US 7,793,641 B2
(45) Date of Patent: Sep. 14, 2010

(54) MODEL-BASED FUEL CONTROL FOR ENGINE START AND CRANK-TO-RUN TRANSITION

(75) Inventors: Qi Ma, Farmington Hills, MI (US); Stephen Yurkovich, Columbus, OH (US); Kenneth P. Dudek, Rochester Hills, MI (US); Stephen K. Fulcher, Clovis, NM (US); Robert X. Monchamp, Ann Arbor, MI (US); Jon C. Miller, Fenton, MI (US)

(73) Assignee: GM Global Technology Operations, Inc.

( * ) Notice: Subject to any disclaimer, the term of this patent is extended or adjusted under 35 U.S.C. 154(b) by 967 days.

(21) Appl. No.: 11/390,978

(22) Filed: Mar. 28, 2006

(65) Prior Publication Data

US 2006/0243039 A1 Nov. 2, 2006

Related U.S. Application Data

(60) Provisional application No. 60/676,606, filed on Apr. 29, 2005.

(51) Int. Cl.
*F02M 51/00* (2006.01)
*F02M 51/06* (2006.01)

(52) U.S. Cl. ..... 123/491; 123/179.16

(58) Field of Classification Search ..... 123/491, 123/179.16, 179.17, 179.18, 179.1, 478, 123/480; 73/118.2, 117.3, 119 A; 701/103, 701/104, 113

See application file for complete search history.

(56) References Cited

U.S. PATENT DOCUMENTS

| | | | | |
|---|---|---|---|---|
| 5,012,422 | A * | 4/1991 | Takahashi et al. | 701/106 |
| 5,094,213 | A | 3/1992 | Dudek et al. | |
| 5,270,935 | A | 12/1993 | Dudek et al. | |
| 5,293,553 | A | 3/1994 | Dudek et al. | |
| 5,465,617 | A | 11/1995 | Dudek et al. | |
| 6,704,638 | B2 * | 3/2004 | Livshiz et al. | 701/102 |
| 6,827,069 | B1 | 12/2004 | Dudek et al. | |
| 7,200,486 | B2 * | 4/2007 | Tanaka et al. | 701/109 |
| 2006/0243255 | A1 * | 11/2006 | Ma et al. | 123/491 |

* cited by examiner

*Primary Examiner*—Mahmoud Gimie

(57) ABSTRACT

A fuel control system for regulating fuel to cylinders of an internal combustion engine during an engine start and crank-to-run transition includes a first module that determines a plurality of step-ahead cylinder air masses (GPOs) for a cylinder based on a plurality of GPO prediction models. A second module regulates fueling to a cylinder of the engine based on the plurality of step-ahead GPOs until a combustion event of the cylinder.

28 Claims, 5 Drawing Sheets

MODEL-BASED FUEL CONTROL FOR ENGINE START AND CRANK-TO-RUN TRANSITION

CROSS-REFERENCE TO RELATED APPLICATIONS

This application claims the benefit of U.S. Provisional Application No. 60/676,606, filed on Apr. 29, 2005. The disclosure of the above application is incorporated herein by reference.

FIELD OF THE INVENTION

The present invention relates to internal combustion engines, and more particularly to regulating fuel to an engine during an engine start and crank-to-run transition.

BACKGROUND OF THE INVENTION

Internal combustion engines combust a fuel and air mixture within cylinders driving pistons to produce drive torque. During engine start-up, the engine operates in transitional modes including key-on, crank, crank-to-run and run. The key-on mode initiates the start-up process and the engine is cranked (i.e., driven by a starter motor) during the crank mode. As the engine is fueled and the initial ignition event occurs, engine operation transitions to the crank-to-run mode. Eventually, when all cylinders are firing and the engine speed is above a threshold level, the engine transitions to the run mode.

Accurate control of fueling plays an important roll in enabling rapid engine start and reduced variation in start time (i.e., the time it takes to transition to the run mode) during the transitional engine start-up. Traditional transitional fuel control systems fail to adequately account for lost fuel and fail to detect and ameliorate misfires and poor-starts during the transitional phases. Further, traditional fuel control systems are not sufficiently robust and require significant calibration effort.

SUMMARY OF THE INVENTION

Accordingly, the present invention provides a fuel control system for regulating fuel to cylinders of an internal combustion engine during an engine start and crank-to-run transition. The fuel control system includes a first module that determines a plurality of step-ahead cylinder air masses (GPOs) for a cylinder based on a plurality of GPO prediction models. A second module regulates fueling to a cylinder of the engine based on the plurality of step-ahead GPOs until a combustion event of the cylinder.

In other features, the fuel control system further includes a third module that determines a corrected injected fuel mass based on an engine temperature and a measured burned fuel mass that is determined based on the step-ahead GPOs. A fourth module determines a raw injected fuel mass based on the corrected injected fuel mass and the engine temperature. A fifth module determines the measured burned fuel mass based on the step-ahead GPOs and a commanded equivalency ratio.

In other features, the plurality of GPO prediction models include a crank model that is processed during a crank period, a crank-to-run model that is processed during a crank-to-run period and a run model that is processed during a run period. The first module transitions to processing the crank-to-run model at a first combustion event and transitions to processing the run model when an engine speed exceeds a threshold engine speed.

In other features, the plurality of GPO prediction models include a misfire model that is processed during a crank-to-run period if a misfire is detected after a first combustion event. Misfire is detected when an engine speed is less than a threshold engine speed.

In still other features, the plurality of GPO prediction models include a poor-start model that is processed during a crank-to-run period if poor-start is detected after a second combustion event. Poor-start is detected when an engine speed is less than a threshold engine speed.

In yet another feature, the step-ahead GPOs are filtered using a GPO filter when one of a misfire and a poor-start condition occur.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
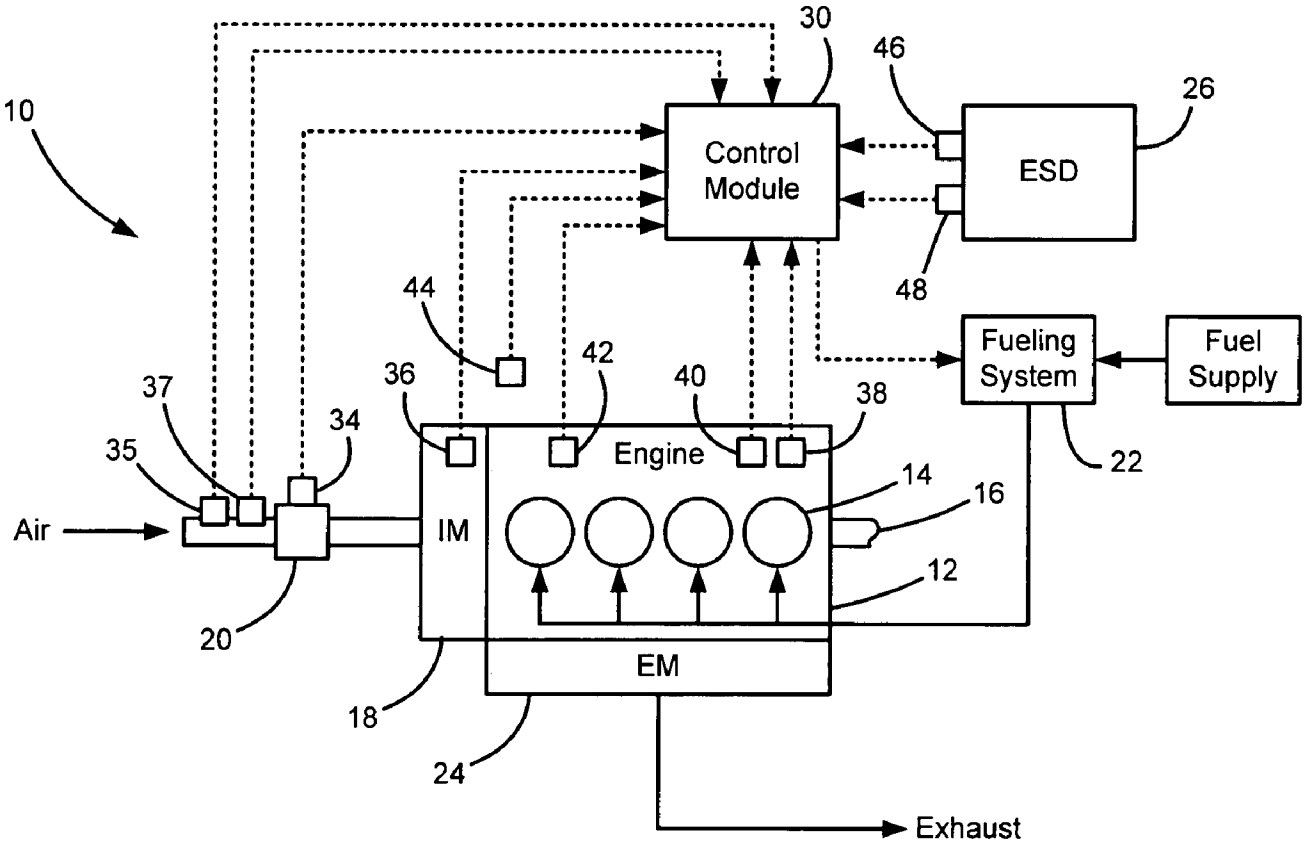
FIG. 1 is a schematic illustration of an exemplary engine system regulated using the transitional fuel control of the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an exemplary vehicle system 10 is schematically illustrated. The vehicle system includes an engine 12 that combusts a fuel and air mixture within cylinders 14 to drive pistons slidably disposed within the cylinders 14. The pistons drive a crankshaft 16 to produce drive torque. Air is drawn into an intake manifold 18 of the engine 12 through a throttle 20. The air is distributed to the cylinders 14 and is mixed with fuel from a fueling system 22. The air and fuel mixture is ignited or sparked to initiate combustion. Exhaust produced by combustion is exhausted from the cylinders 14 through an exhaust manifold 24. An energy storage device (ESD) 26 provides electrical energy to various components of the vehicle system. For example, the ESD 26 provides electrical energy to produce spark and provides electrical energy to rotatably drive the crankshaft 16 during engine start-up.

A control module 30 regulates overall operation of the vehicle system 10. The control module 30 is responsive to a plurality of signals generated by various sensors, as described in further detail below. The control module 30 regulates fuel flow to the individual cylinders based on the transitional fuel control of the present invention, during transitions across a key-on mode, a crank mode, a crank-to-run mode and a run mode. More specifically, during engine start-up, the initial mode is the key-on mode, where a driver turns the ignition key to initiate engine start-up. The crank mode follows the key-on mode and is the period during which a starter motor (not illustrated) rotatably drives the pistons to enable air processing in the cylinders 14. The crank-to-run mode is the period during which the initial ignition event occurs prior to normal engine operation in the run mode.

The vehicle system 10 includes a mass air flow (MAF) sensor 32 that monitors the air flow rate through the throttle 20. A throttle position sensor 34 is responsive to a position of a throttle plate (not shown) and generates a throttle position signal (TPS). An intake manifold pressure sensor 36 generates a manifold absolute pressure (MAP) signal and an engine speed sensor 38 generates and engine speed (RPM) signal. An engine oil temperature sensor 40 generates an engine oil temperature ($T_{OIL}$) signal and an engine coolant temperature sensor 42 generates an engine coolant temperature (ECT) signal. A pressure sensor 44 is responsive to the atmospheric pressure and generates a barometric pressure ($P_{BARO}$) signal. Current and voltage sensors 46,48, respectively, generate current and voltage signals of the ESD 26. An intake air temperature (IAT) sensor 49 generates an IAT signal.

The transitional fuel control of the present invention calculates a raw injected fuel value (RINJ) to be injected into each cylinder during transition from engine start to crank-to-run. More specifically, the transitional fuel control predicts cylinder air charge (GPO) and determines RINJ based on GPO. The transitional fuel control implements a plurality of functions including, but not limited to: crank GPO prediction, crank-to-run GPO prediction, run GPO prediction, a scheduled GPO filter, misfire detection, poor-start detection, poor-start recovery detection, misfire/poor-start GPO prediction, transition rules, utilized fuel fraction (UFF) calculation, nominal fuel dynamics model and control, a fuel dynamics control strategy and individual cylinder fuel prediction scheduling and command scheduling. It is assumed that the most accurate way to estimate the true GPO is using bottom dead center (BDC) MAP data. Due to hardware constraints, the closest MAP measurement is sampled at a specified cylinder event. An exemplary cylinder event for an exemplary 4 cylinder engine is at approximately 60°-75° degrees crank angle (CA) before intake BDC. There is a specific CA value between cylinder events. For example, for a the exemplary 4 cylinder engine, there is 180° CA between events.

The crank GPO prediction consists of 1st, 2nd and 3rd step ahead GPO predictions, with a measurement update. The crank GPO prediction is used during operation in the crank mode. The following equations are associated with the crank GPO prediction:

$$GPO_{k+3|k}=\alpha_{CRK}GPO_{k+2|k}+(1-\alpha_{CRK})GPO_{k+1|k} \quad (1)$$

$$GPO_{k+2|k}=\alpha_{CRK}GPO_{k+1|k}+(1-\alpha_{CRK})GPO_{k|k} \quad (2)$$

$$GPO_{k+1|k}=\alpha_{CRK}GPO_{k|k}+(1-\alpha_{CRK})GPO_{k-1|k} \quad (3)$$

$$GPO_{k|k}=GPO_{k|k-1}+KG(GPO_k-GPO_{k|k-1}) \quad (4)$$

Equation 1 is the 3rd step ahead prediction, Equation 2 is the 2nd step ahead prediction, Equation 3 is the 1st step ahead prediction and Equation 4 is a measurement update. $\alpha_{CRK}$ is a single fixed number for all engine start conditions and KG denotes a steady-state Kalman filter gain. Because the crank GPO predictor only runs for a short period of time (e.g., only the first three engine events for the exemplary I-4 engine), $\alpha_{CRK}$ is tuned manually. The subscript k|k−1 denotes the value at current event k using information up through previous event k−1, k|k denotes the value at current event k using information up through current event k, k+1|k denotes the value up through future event k+1 using information up through current event k and so on.

$GPO_k$ is calculated based on the following equation:

$$GPO_k=\alpha_{CRK\text{-}VE}VE_{CRK}MAP_k/IAT_k \quad (5)$$

where $VE_{CRK}$ is the volumetric efficiency at the cranking speed, which is calculated from the geometry of the piston and cylinder head using a known compression ratio, $\alpha_{CRK\text{-}VE}$ is a scaling coefficient used to match the units of $VE_{CRK}$ and $MAP_k/IAT_k$.

The crank-to-run GPO prediction also includes 1st, 2nd and 3rd step ahead GPO predictions and measurement update. As explained in further detail below, there is a transitional period during which the crank GPO prediction and the crank-to-run GPO prediction function concurrently. Once wholly in the crank-to-run mode, the crank-to-run GPO prediction is used alone. The crank-to-run GPO prediction is used to predict GPO for those cylinders that will ingest their air charge during operation in the crank-to-run mode. The equations associated with the crank-to-run GPO prediction are provided as:

$$GPO_{k+3|k}=\alpha_{CTR}GPO_{k+2|k} \quad (6)$$

$$GPO_{k+2|k}=\alpha_{CTR}GPO_{k+1|k} \quad (7)$$

$$GPO_{k+1|k}=\alpha_{CTR}GPO_{k|k} \quad (8)$$

$$GPO_{k|k}=GPO_{k|k-1}+KG(GPO_k-GPO_{k|k-1}) \quad (9)$$

where Equation 6 is the 3rd step ahead prediction, Equation 7 is the 2nd step ahead prediction, Equation 8 is the 1st step ahead prediction and Equation 9 is the measurement update. The predictor coefficient, $\alpha_{CTR}$, where the subscript CTR denotes crank-to-run condition, is a linear spline function of TPS and engine RPM signals and is provided as:

$$\alpha_{CTR} = c_0 + \sum_{i=1}^{n} a_i \times UTPS(i) + \sum_{j=1}^{m} b_j + URPM(j) \quad (10)$$

where $$UTPS(i) = \begin{cases} 0 & \text{if } TPS \le TPS_i \\ TPS - TPS_i & \text{otherwise} \end{cases} \quad (11)$$

and $$URPM(j) = \begin{cases} 0 & \text{if } RPM \le RPM_j \\ RPM - RPM_j & \text{otherwise} \end{cases} \quad (12)$$

The following definitions are also provided:

$$R_{i,j}=\{[TPS_i,TPS_{i+1}),[RPM_j,RPM_{j+1})\}\ i=1,2,\ldots n-1\ j=1,2,\ldots m-1 \quad (13)$$

$$R_{n,j}=\{[TPS_n,\infty),[RPM_j,RPM_{j+1})\}\ j=1,2,\ldots m-1 \quad (14)$$

$$R_{j,m}=\{[TPS_i,TPS_{i+1}),[RPM_m,\infty)\}\ i=1,2,\ldots n-1 \quad (15)$$

$$R_{n,m}=\{[TPS_n,\infty),[RPM_m,\infty)\} \quad (16)$$

when (TPS,RPM)$\epsilon R_{i,j}$, $\alpha_{CTR}$ can be rewritten as:

$$\alpha_{CTR}=\delta_0+\delta_1\times TPS+\delta_2\times RPM \quad (17)$$

where:

$$\delta_0 = c_0 - \sum_{k=1}^{i} a_k \times TPS_k - \sum_{k=1}^{j} b_k \times RPM_k \quad (18)$$

$$\delta_1 = \sum_{k=1}^{i} a_k \quad (19)$$

$$\delta_2 = \sum_{k=1}^{j} b_k \quad (20)$$

Exemplary values of $TPS_i$ and $RPM_j$ are (5, 15, 20, 30, ∞) and (600, 1200, 1800, ∞), respectively.

In the Equation 9, $GPO_k$ is calculated based on the following equation:

$$GPO_k=\alpha_{RUN\text{-}VE}VE_{RUN}(MAP_k,RPM_k)MAP_k/IAT_k \quad (21)$$

where $VE_{RUN}(.)$ is the volumetric efficiency at the normal or run operating condition and is determined based on MAP and RPM, and $\alpha_{RUN\text{-}VE}$ is a scaling coefficient used to match the units of $VE_{RUN}(.)$ and $MAP_k/IAT_k$.

The run GPO prediction includes 1st, 2nd and 3rd step ahead GPO predictions and a measurement update. The run GPO prediction is used during the run mode. The equations associated with the run GPO prediction are provided as:

$$GPO_{k+3|k}=\alpha_{RUN}GPO_{k+2|k}+U(TPS,GPC) \quad (22)$$

$$GPO_{k+2|k}=\alpha_{RUN}GPO_{k+1|k}+U(TPS,GPC) \quad (23)$$

$$GPO_{k+1|k}=\alpha_{RUN}GPO_{k|k}+U(TPS,GPC) \quad (24)$$

$$GPO_{k|k}=GPO_{k|k-1}+KG(GPO_k-GPO_{k|k-1}) \quad (25)$$

where Equation 22 is the 3rd step ahead prediction, Equation 23 is the 2nd step ahead prediction, Equation 24 is the 1st step ahead prediction and Equation 25 is the measurement update. The input function U(TPS,GPC) is a function of TPS and the cylinder air charge as measured at the throttle (GPC) based on MAF, and is provided as:

$$U(TPS,\ GPC) = \sum_{i=1}^{3} \beta_i TPS_{k-i+1} + \sum_{j=1}^{3} \gamma_j GPC_{k-j+1} \quad (26)$$

The parameter constraints of the run GPO predictor and the input function are $\oplus_1+\beta_2+\beta_3=0$ and $1-\alpha_{RUN}=\gamma_1+\gamma_2+\gamma_3$ where $\alpha_{RUN}$ is a single fixed number. In Equation 25, $GPO_k$ is calculated as follows:

$$GPO_k=\alpha_{RUN\text{-}VE}VE_{RUN}(MAP_k,RPM_k)MAP_k \quad (27)$$

Figure 2:
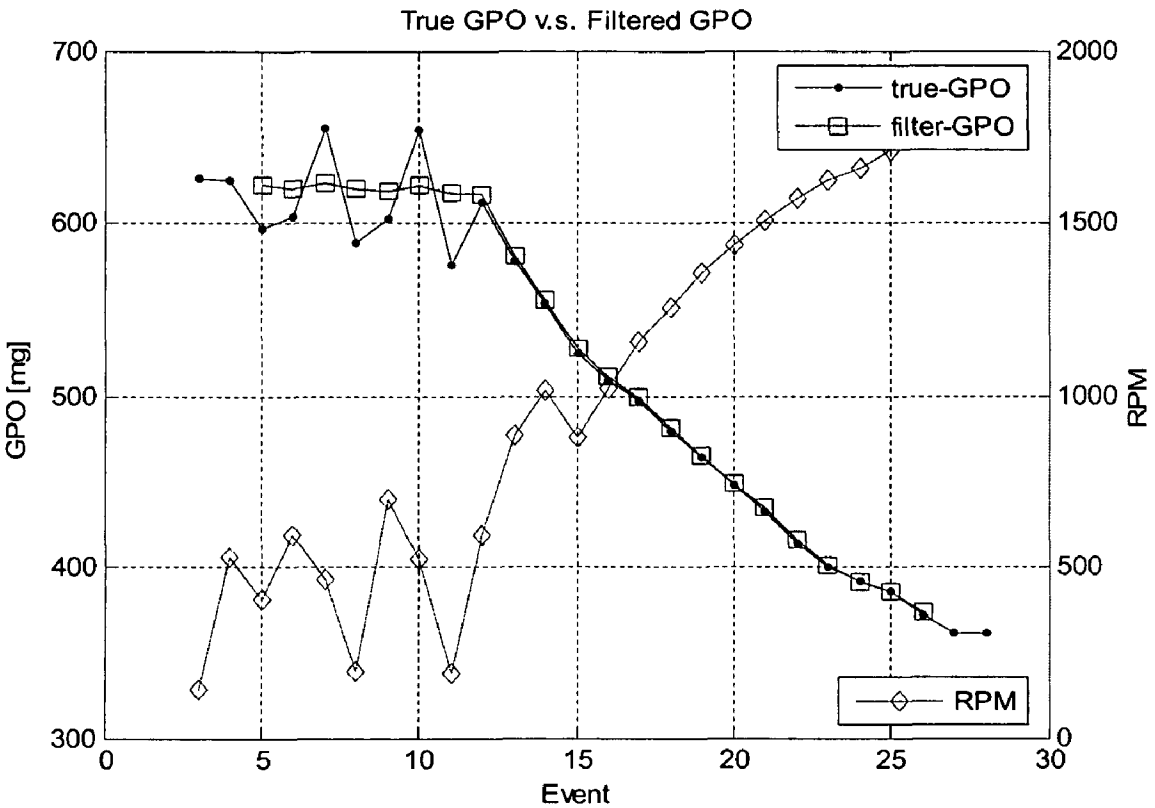
FIG. 2 is a graph illustrating an exemplary actual cylinder air charge (GPO) versus an exemplary filtered GPO during an anomalous engine start.

Referring now to FIG. 2, under anomalous engine starts (e.g., misfire and/or poor start conditions), the GPO measurement can have undesired fluctuations. This may cause the GPO prediction to exhibit undesired behavior. The exemplary data trace of a poor start is illustrated in FIG. 2. The filtered GPO is better behaved (i.e., has less fluctuation) and is therefore more useful than the measured GPO in GPO prediction. The GPO filter scheduling is based on the firing behavior of the engine. More specifically, for normal engine starts (i.e., normal mode) the filtered GPO ($GPOF_k$) is provided as:

$$GPOF_k=0.1GPOF_{k-1}+0.9GPO_k \quad (28)$$

For anomalous engine starts (including misfire and/or poor start) $GPOF_k$ is provided as:

$$GPOF_k=0.9GPOF_{k-1}+0.1GPO_k \quad (29)$$

Because the fast GPO decay starts from a specific event (e.g., Event 4 for the exemplary I-4 engine), the GPO filter is only activated from that event forward. Therefore, from that event forward $GPO_k$, appearing in all prediction equations described above, are replaced by $GPOF_k$. It is appreciated that the values 0.1 and 0.9 are merely exemplary in nature.

Under normal engine starts, the time constant of the GPO filter is 0.1 and does not play a role in filtering the true measured GPO. In this case, the benefit of using filtered GPO is not obvious. However, in the case of anomalous engine starts, the time constant of the GPO filter can be as large as 0.9. This scheme provides a safety-net implemented in the overall GPO prediction scheme. When the engine recovers from misfire or poor start, the GPO filter is switched to normal operating mode.

Engine misfire detection is performed based on monitoring an RPM difference across events, between which the first firing occurs. For the exemplary I-4 engine having known cam position, the first firing occurs between Event 3 and Event 4. Therefore, misfire can be detected on Event 4. The detection rule for the misfire is defined as follows:

If $\Delta RPM=(RPM_4-RPM_3)<\Delta RPM_{1st\text{-}fire}$, misfire is detected.

where $\Delta RPM_{1st\text{-}fire}$ (i.e., change in RPM due to first fire) is a calibratable number (e.g., approximately 200 RPM). For engines with more than four cylinders, the detection rule can be adjusted accordingly. The notation $RPM_k$ refers to the RPM at event k.

Poor start can be detected based on a threshold RPM after the $2^{nd}$ combustion event. Under normal conditions for the exemplary I-4 engine, the $2^{nd}$ combustion occurs between Event 4 and Event 5 and is capable of bringing the engine speed to a value greater than a threshold RPM (e.g., 700 RPM). Therefore, the rule for poor-start detection is defined as follows:

If $RPM_{k\geqq 5}\leqq 700$, poor start is detected.

If the engine is operating in poor-start mode and $RPM_k\geqq 1400$, poor-start recovery is detected. The RPM threshold for poor-start recovery can be defined at the instant when both $RPM_k\geqq 1400$ and the first reliable reading of GPC is available. It is appreciated that the threshold RPM values provided herein are merely exemplary in nature. When poor-start recovery is detected, the GPO filter is switched to normal mode accordingly and the GPO prediction is made using the run GPO predictor.

If the engine is operating in the misfire mode, the misfire GPO prediction replaces the crank-to-run GPO prediction.

The misfire GPO prediction implements the following equations:

$$GPO_{k+3|k}=\alpha_{MIS}^3 GPO_{k|k} \quad (30)$$

$$GPO_{k+2|k}=\alpha_{MIS}^2 GPO_{k|k} \quad (31)$$

$$GPO_{k+1|k}=\alpha_{MIS} GPO_{k|k} \quad (32)$$

$$GPO_{k|k}=GPO_{k|k-1}+KG(GPO_k-GPO_{k|k-1}) \quad (33)$$

where Equation 30 is the $3^{rd}$ step ahead prediction, Equation 31 is the $2^{nd}$ step ahead prediction, Equation 32 is the $1^{st}$ step ahead prediction and Equation 33 is the measurement update and exemplary values $\alpha_{MIS}=1$ and KG=0.8 are provided. It is appreciated, however, that these values may vary based on engine specific parameters.

If the engine is operating in the poor-start mode, the poor-start GPO prediction replaces the crank-to-run prediction. The poor-start GPO prediction implements the following equations:

$$GPO_{k+3|k}=\alpha_{PS}^3 GPO_{k|k} \quad (34)$$

$$GPO_{k+2|k}=\alpha_{PS}^2 GPO_{k|k} \quad (35)$$

$$GPO_{k+1|k}=\alpha_{PS} GPO_{k|k} \quad (36)$$

$$GPO_{k|k}=GPO_{k|k-1}+KG(GPO_k-GPO_{k|k-1}) \quad (37)$$

where Equation 34 is the $3^{rd}$ step ahead prediction, Equation 35 is the $2^{nd}$ step ahead prediction, Equation 36 is the $1^{st}$ step ahead prediction and Equation 37 is the measurement update and exemplary values $\alpha_{PS}=0.98$ and KG=0.8 are provided. It is appreciated, however, that these values may vary based on engine specific parameters.

For the exemplary 4-cylinder engine, the rules to define the transition between modes are summarized below. With a known cam position, Event 4 is the default event for the transition from the crank mode to the crank-to-run mode. At Event 4, if the change in RPM is less than a calibratable number (e.g., 200 RPM), weak-fire is detected, the weak-fire GPO prediction is activated and the anomalous GPO filter and the weak-fire GPO prediction are used. At Event 5, if engine speed is less than a calibratable number (e.g., 700 RPM), poor-start is predicted and the poor start GPO prediction is activated. Concurrently, the anomalous GPO filter is activated. Otherwise, the normal GPO filter and the crank-to-run GPO prediction are activated. If the engine speed passes the calibratable RPM threshold (e.g., 1400 RPM), either from a poor-start recovery mode or a normal start mode, the prediction scheme switches to the run GPO prediction. For engines with more than 4 cylinders, similar but modified rules are applied.

Figure 3:
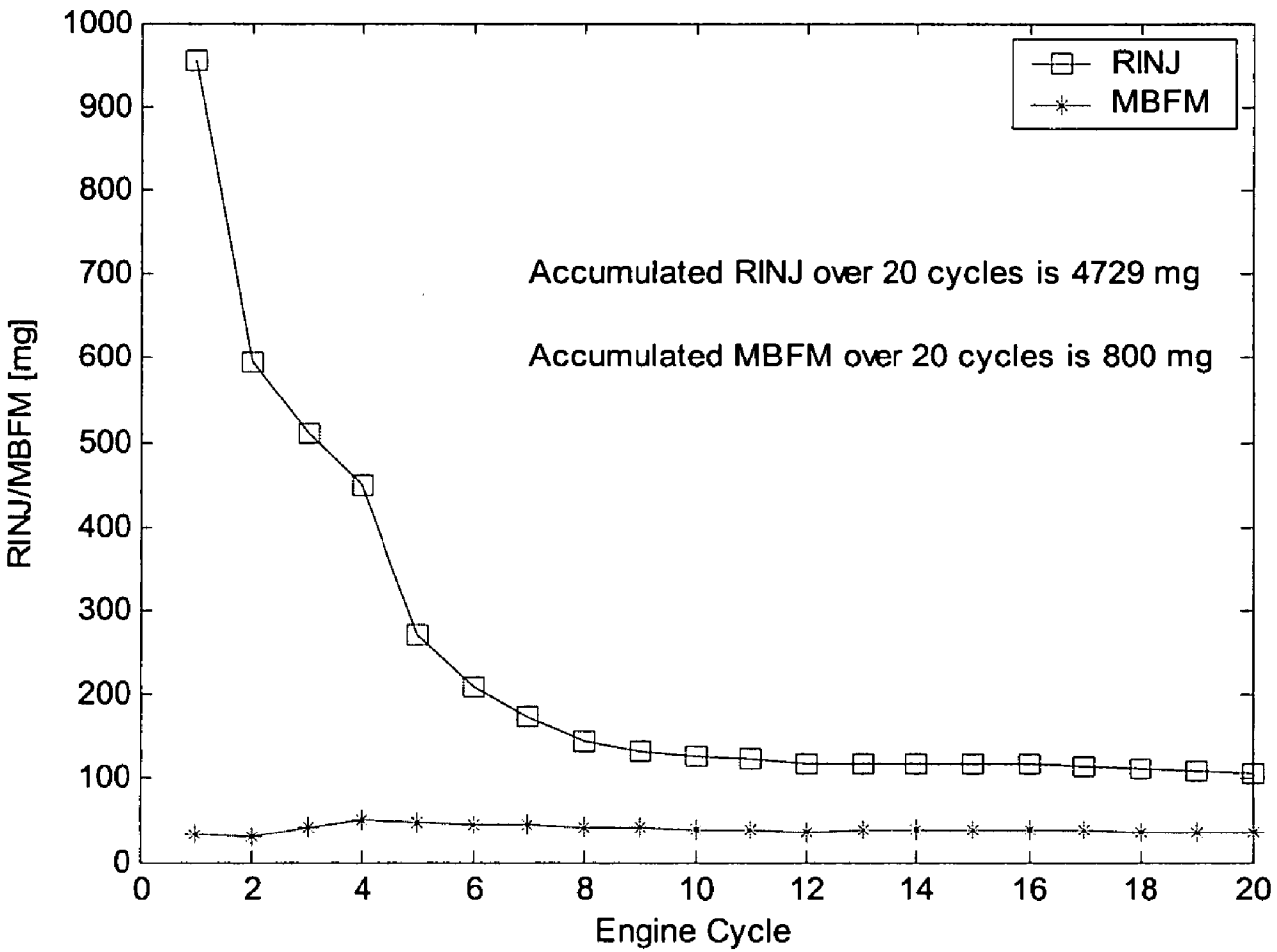
FIG. 3 is a graph illustrating an exemplary raw injected fuel mass (RINJ) and an exemplary measured burned fuel mass (MBFM) over a plurality of engine cycles.

Referring now to FIG. 3, the utilized fuel fraction (UFF) will be described in detail. The UFF is the percentage of fuel actually burned in the current combustion event and is based on experimental observations. More specifically, the UFF is a fraction of the raw injected fuel mass (RINJ) to the measured burned fuel mass (MBFM). There is an amount of RINJ which does not participate in the combustion process. The effect of such a phenomenon is illustrated in FIG. 3 where the total amount of RINJ does not show up in the exhaust measurement and an effect of diminishing return is observed. This incomplete fuel utilization phenomenon indicates that the utilization rate is not a constant number and is a function of RINJ.

The transitional fuel control of the present invention models this crucial nonlinearity by separating the overall fuel dynamics into two cascaded subsystems: nonlinear input (RINJ) dependent UFF and a unity-gained nominal fuel dynamics function. The input (RINJ) dependent UFF function is provided as:

$$CINJ(k) = UFF_{SS}\left(1 - \frac{2}{\pi}\arctan\left(\frac{RINJ(k)}{\gamma(ECT)}\right)\right)RINJ(k) \quad (38)$$

where CINJ is the corrected amount of fuel mass that is injected by accounting for the UFF. The sub-script SS indicates the cycle at which the engine air dynamics achieve a steady/state. Although an exemplary value of SS equal to 20 (i.e., the $20^{th}$ cycle), it is appreciated that this value can vary based on engine specific parameters. The UFF function is defined as follows:

$$UFF = UFF_{20}\left(1 - \frac{2}{\pi}\arctan\left(\frac{RINJ(k)}{\gamma(ECT)}\right)\right) \quad (39)$$

In the above expressions, $UFF_{20}$ denotes the UFF calculated at cycle 20. The parameter γ(ECT) is used to characterize a shape that meets the correction requirement to capture the diminishing return effect. This single ECT-based parameter simplifies the calibration process and permits a robust parameter estimate when data richness is an issue. The magnitude of γ(ECT) is in the same range of the first indexed RINJ (RINJ (1)) during a normal engine start for a given, fixed ECT. γ(ECT) is therefore viewed as a weighting parameter for RINJ correction in the first few engine cycles.

The forward, mass conservative or unity gained nominal fuel dynamics (NFD) model is represented using the following equation:

$$y(k)=-\beta_1 y(k-1)+\alpha_0 u(k)+\alpha_1 u(k-1) \quad (40)$$

where y(k) denotes the MBFM and u(k) indicates CINJ. Equation 40 is subject to a unity constraint: $1+\beta_1=\alpha_0+\alpha_1$. Although the NFD model structure is a first order linear model, the model parameters are a function of ECT. In addition, under a normal engine start, parameters $\alpha_0$, $\alpha_1$ and $\beta_1$ are also mildly influenced by the RPM and MAP. However, under anomalous engine starts, control using such a model structure and parameter setup (i.e., capturing the MAP and RPM effect) can result in inappropriate fuel dynamics compensation due to insufficient accuracy of MAP and RPM predictions. Therefore, the $\alpha_0$, $\alpha_1$ and $\beta_1$ parameters are functions of ECT only. When used in transition fuel control, Equation 40 is converted to provide:

$$u(k) = -\frac{\alpha_1}{\alpha_0}u(k-1) + \frac{1}{\alpha_0}y(k) + \frac{\beta_1}{\alpha_0}y(k-1) \quad (41)$$

where y(k) is the desired in-cylinder burned fuel mass (i.e., commanded fuel).

Figure 4:
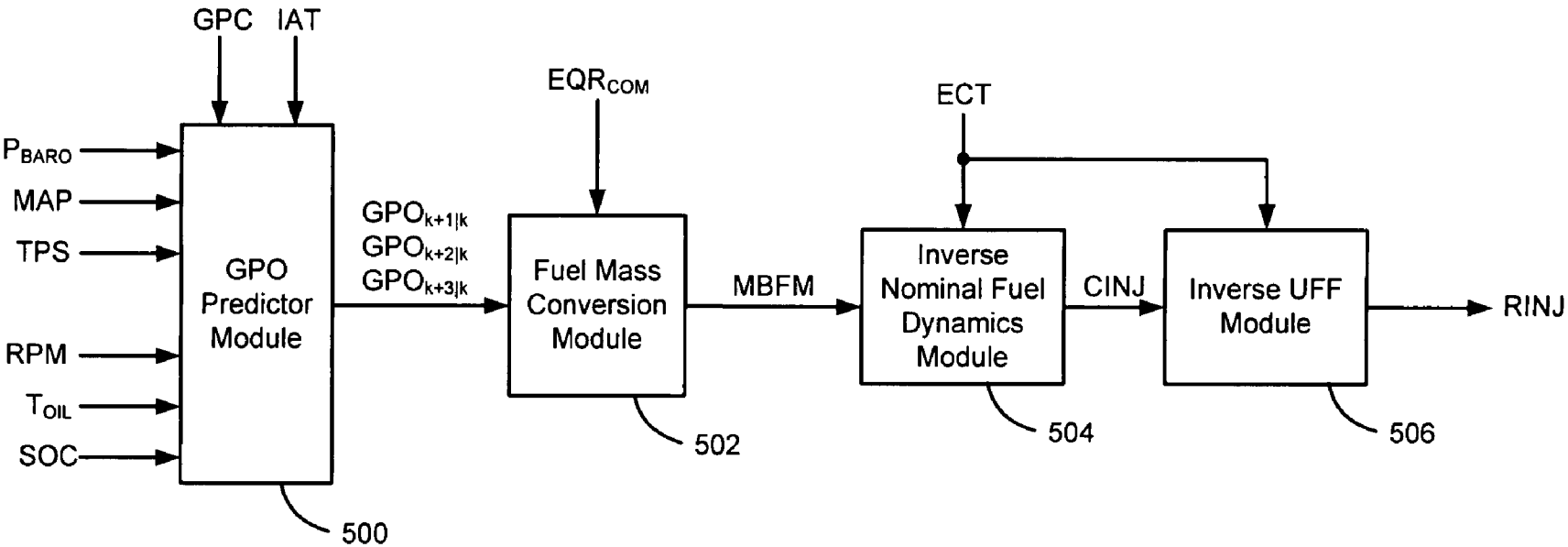
FIG. 4 is a signal flow diagram illustrating exemplary modules that execute the transitional fuel control of the present invention.

Referring now to FIG. 4, exemplary modules that execute the transitional fuel control are illustrated. Fuel control generally includes the GPO prediction (i.e., multi-step GPO predictor for crank, crank-to-run and run), conversion of the predicted GPO and the commanded equivalence ratio (EQR) trajectory to the fuel mass command, nominal inverse fuel dynamics scheduled based on ECT and inverse UFF function scheduled based on ECT. $EQR_{COM}$ is determined as the ratio of the commanded fuel to air ratio to the stoichiometric fuel to air ratio and is used to negate differences in fuel compositions and to provide robust fueling to the engine in cold start conditions. The stoichiometric fuel to air ratio is the specific air to fuel ratio at which the hydrocarbon fuel is completely oxidized. The modules include, but are not limited to, a GPO predictor module 500, a fuel mass conversion module 502, an inverse nominal fuel dynamics module 504 and an inverse UFF module 506.

The GPO predictor module 500 generates $GPO_{k+1|k}$, $GPO_{k+2|k}$ and $GPO_{k+3|k}$ based on $P_{BARO}$, MAP, TPS, RPM, $T_{OIL}$, SOC, GPC and IAT. The particular prediction model or models used depend on the current event number and the engine mode (e.g., misfire and poor-start) and include crank GPO prediction, crank-to-run GPO prediction and run GPO prediction, misfire GPO prediction and poor-start GPO prediction. The fuel mass conversion module 502 determines MBFM based on the GPO values and $EQR_{COM}$. The inverse nominal fuel dynamics module 504 determines CINJ based on MBFM and ECT. The inverse UFF module 506 determines RINJ based on CINJ and ECT. The cylinders are fueled based on the respective RINJs.

Figure 5:
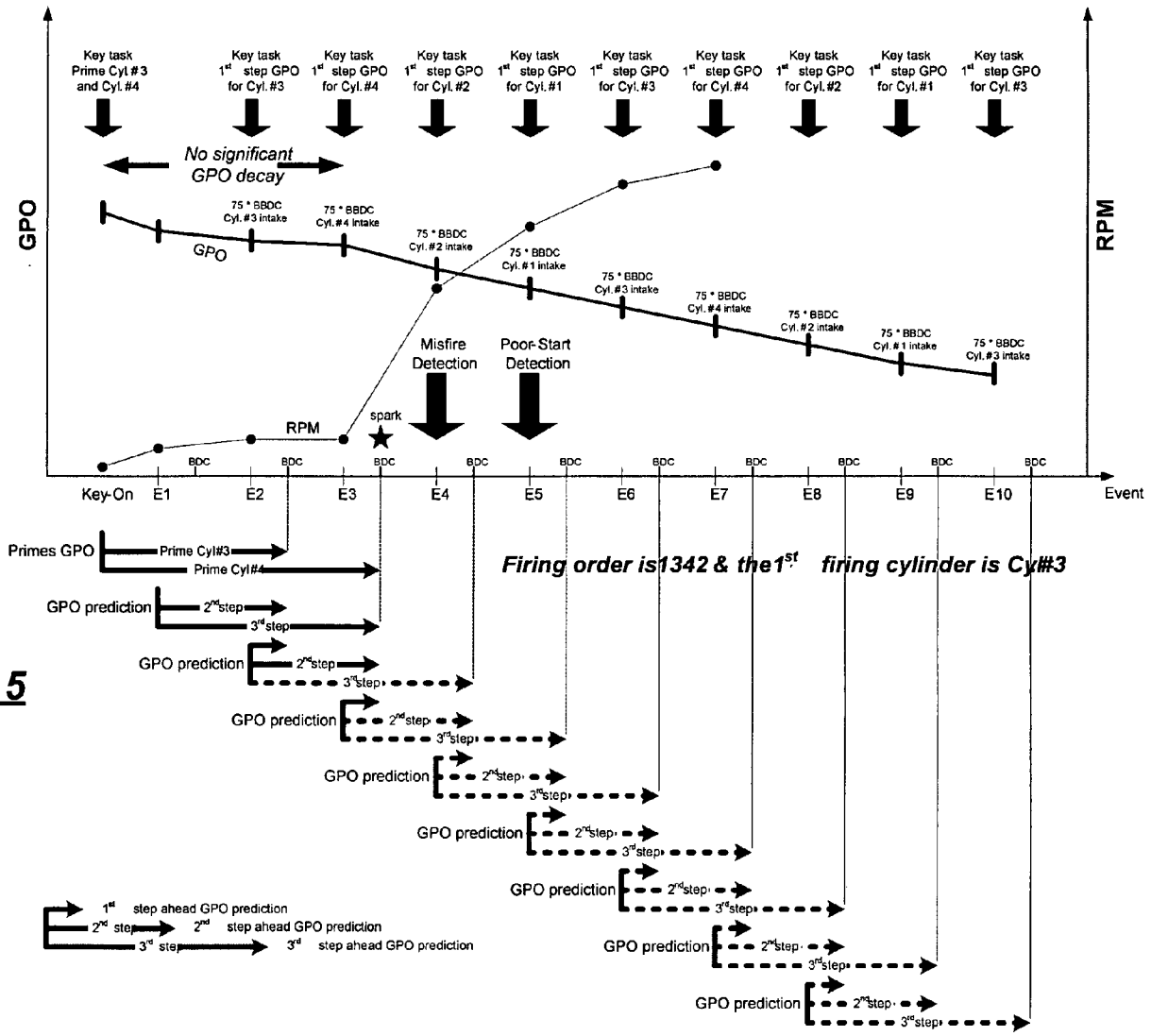
FIG. 5 is a graph illustrating an exemplary event resolved GPO prediction scheme according to the present invention.

Referring now to FIG. 5, an event resolved GPO prediction scheduling scheme is graphically illustrated for the exemplary 4 cylinder engine. It is appreciated that the GPO prediction scheduling scheme can be adjusted for application to engines having a differing number of cylinders. It is also appreciated that the graph of FIG. 5 is for the exemplary engine in an exemplary starting position where cylinder #3 is the first cylinder that is able to be fired. The transitional fuel control or the present invention is applicable to other starting positions (e.g., cylinder #1 is the first cylinder that is able to be fired).

A key-on event initiates cranking of the engine and only two cylinders are primed (e.g., for a 4 cylinder engine) to avoid open valve injection in case of a mis-synchronization. Cylinder #1 cannot be fueled due to the open intake valve. The primed fuel shots are calculated using the crank GPO prediction. At the first event (E1), where cylinder #1 is at 75° CA before BDC intake and no fuel is injected, a mis-synchronization correction is performed and only the crank GPO prediction is operating. Also at E1, a $2^{nd}$ step ahead prediction of GPO for cylinder #3 and a $3^{rd}$ step ahead prediction of GPO for cylinder #4 are performed. Respective RINJs are determined based on the $2^{nd}$ and $3^{rd}$ step ahead GPOs and Cylinders #3 and #4 are fueled based on the RINJs.

At the second event (E2), cylinder #3 is at 75° CA before BDC and the $1^{st}$ step ahead GPO prediction and fuel command are made. The crank GPO prediction and the crank-to-run GPO prediction are operating simultaneously. More specifically, at E2, a $1^{st}$ step ahead prediction of GPO for cylinder #3 and a $2^{nd}$ step ahead prediction of GPO for cylinder #4 are determined using the crank GPO prediction (see solid arrows). A $3^{rd}$ step ahead prediction of GPO for cylinder #2 is determined using the crank-to-run GPO prediction (see phantom arrow). Respective RINJs are calculated based on the GPO predictions and cylinders #3, #4 and #2 are fueled based on the RINJs through to the next event.

At the third event, cylinder #4 is at 75° CA before BDC, the crank GPO prediction and the crank-to-run GPO prediction are operating simultaneously and the fuel dynamics initial condition of cylinder #3 is no longer zero and must be accounted for in the next fueling event. More specifically, at E3, a $1^{st}$ step ahead prediction of GPO for cylinder #4 is determined using the crank GPO prediction (see solid arrow). A $2^{nd}$ step ahead GPO prediction for cylinder #2 and a $3^{rd}$ step ahead GPO prediction for cylinder #1 are determined using the crank-to-run prediction (see phantom arrows). Respective RINJs are calculated based on the predictions and cylinders #4, #2 and #1 are fueled based on the RINJs through to the next event.

At the fourth event (E4), cylinder #2 is at 75° CA before BDC, misfire detection is performed and the fuel dynamics initial condition of cylinder #4 is no longer zero and must be accounted for in the next fueling event. If there is no misfire detected, a $1^{st}$ step ahead GPO prediction for cylinder #2, a $2^{nd}$ step ahead GPO prediction for cylinder #1 and a $3^{rd}$ step ahead GPO prediction for cylinder #3 are determined using the crank-to-run prediction (see phantom arrows). If there a misfire is detected, a $1^{st}$ step ahead GPO prediction for cylinder #2, a $2^{nd}$ step ahead GPO prediction for cylinder #1 and a $3^{rd}$ step ahead GPO prediction for cylinder #3 are determined using the misfire prediction. Respective RINJs are calculated based on the GPO predictions and cylinders #2, #1 and #3 are fueled based on the RINJs through to the next event.

At the fifth event (E5), cylinder #1 is at 75° CA before BDC, poor start detection is performed and the fuel dynamics initial condition of cylinder #2 is no longer zero and must be accounted for in the next fueling event. If poor-start is not detected, a $1^{st}$ step ahead GPO prediction for cylinder #1, a $2^{nd}$ step ahead GPO prediction for cylinder #3 and a $3^{rd}$ step ahead GPO prediction for cylinder #2 are determined using the run prediction. If poor-start is detected, a $1^{st}$ step ahead GPO prediction for cylinder #1, a $2^{nd}$ step ahead GPO prediction for cylinder #3 and a $3^{rd}$ step ahead GPO prediction for cylinder #2 are determined using the poor-start prediction. Respective RINJs are calculated based on the predictions and cylinders #1, #3 and #4 are fueled based on the RINJs through to the next event. The subsequent events (E6-En) are similar, alternating cylinders based on the firing order (e.g., 1342 with cylinder #3 firing first for the exemplary 4 cylinder engine). When the engine speed is stable and is greater than 1400 RPM, the run GPO prediction is used.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A fuel control system for regulating fuel to cylinders of an internal combustion engine during an engine start and crank-to-run transition, comprising:

a first module that determines a plurality of step-ahead cylinder air masses (GPOs) for a cylinder based on a plurality of GPO prediction models; and a second module that regulates fueling to a cylinder of said engine based on said plurality of step-ahead GPOs until a combustion event of said cylinder.

2. The fuel control system of claim 1 further comprising:

a third module that determines a corrected injected fuel mass based on an engine temperature and a measured burned fuel mass that is determined based on said step-ahead GPOs; and a fourth module that determines a raw injected fuel mass based on said corrected injected fuel mass and said engine temperature.

3. The fuel control system of claim 2 further comprising a fifth module that determines said measured burned fuel mass based on said step-ahead GPOs and a commanded equivalency ratio.

4. The fuel control system of claim 1 wherein said plurality of GPO prediction models include a crank model that is processed during a crank period, a crank-to-run model that is processed during a crank-to-run period and a run model that is processed during a run period.

5. The fuel control system of claim 4 wherein said first module transitions to processing said crank-to-run model at a first combustion event and transitions to processing said run model when an engine speed exceeds a threshold engine speed.

6. The fuel control system of claim 1 wherein said plurality of GPO prediction models include a misfire model that is processed during a crank-to-run period if a misfire is detected after a first combustion event.

7. The fuel control system of claim 6 wherein said misfire is detected when an engine speed is less than a threshold engine speed.

8. The fuel control system of claim 1 wherein said plurality of GPO prediction models include a poor-start model that is processed during a crank-to-run period if poor-start is detected after a second combustion event.

9. The fuel control system of claim 8 wherein said poor-start is detected when an engine speed is less than a threshold engine speed.

10. The fuel control system of claim 1 wherein said step-ahead GPOs are filtered using a GPO filter when one of a misfire and a poor-start condition occur.

11. A method of regulating fuel to cylinders of an internal combustion engine during an engine start and crank-to-run transition, comprising:

determining a plurality of step-ahead cylinder air masses (GPOs) for a cylinder based on a plurality of GPO prediction models; and regulating fueling to a cylinder of said engine based on said plurality of step-ahead GPOs until a combustion event of said cylinder.

12. The method of claim 11 further comprising:

determining a corrected injected fuel mass based on an engine temperature and a measured burned fuel mass that is determined based on said step-ahead GPOs; and determining a raw injected fuel mass based on said corrected injected fuel mass and said engine temperature.

13. The method of claim 12 further comprising determining said measured burned fuel mass based on said step-ahead GPOs and a commanded equivalency ratio.

14. The method of claim 11 wherein said plurality of GPO prediction models include a crank model that is processed during a crank period, a crank-to-run model that is processed during a crank-to-run period and a run model that is processed during a run period.

15. The method of claim 14 further comprising transitioning to processing said crank-to-run model at a first combustion event and transitioning to processing said run model when an engine speed exceeds a threshold engine speed.

16. The method of claim 11 wherein said plurality of GPO prediction models include a misfire model that is processed during a crank-to-run period if a misfire is detected after a first combustion event.

17. The method of claim 16 further comprising detecting said misfire when an engine speed is less than a threshold engine speed.

18. The method of claim 11 wherein said plurality of GPO prediction models include a poor-start model that is processed during a crank-to-run period if poor-start is detected after a second combustion event.

19. The method of claim 18 wherein further comprising detecting said poor-start when an engine speed is less than a threshold engine speed.

20. The method of claim 11 further comprising filtering said step-ahead GPOs using a GPO filter when one of a misfire and a poor-start condition occur.

21. A method of regulating fuel to cylinders of an internal combustion engine during an engine start and crank-to-run transition, comprising:

determining a plurality of step-ahead cylinder air masses (GPOs) for a cylinder based on one of a crank GPO prediction model, a crank-to-run GPO prediction model and a run prediction model;

determining a corrected injected fuel mass based on an engine temperature and a measured burned fuel mass that is determined based on said step-ahead GPOs;

determining a raw injected fuel mass based on said corrected injected fuel mass and said engine temperature;

regulating fueling to a cylinder of said engine based on said raw injected fuel mass until a combustion event of said cylinder.

22. The method of claim 21 further comprising determining said measured burned fuel mass based on said step-ahead GPOs and a commanded equivalency ratio.

23. The method of claim 21 further comprising transitioning to processing said crank-to-run model at a first combustion event and transitioning to processing said run model when an engine speed exceeds a threshold engine speed.

24. The method of claim 21 further comprising processing a misfire model during a crank-to-run period if a misfire is detected after a first combustion event.

25. The method of claim 24 further comprising detecting said misfire when an engine speed is less than a threshold engine speed.

26. The method of claim 21 wherein further comprising processing a poor-start model during a crank-to-run period if poor-start is detected after a second combustion event.

27. The method of claim 26 wherein further comprising detecting said poor-start when an engine speed is less than a threshold engine speed.

28. The method of claim 21 further comprising filtering said step-ahead GPOs using a GPO filter when one of a misfire and a poor-start condition occur.

* * * * *